United States Patent [19]

Whalen-Shaw et al.

[11] 4,389,476

[45] * Jun. 21, 1983

[54] BARRIER COAT FOR ELECTROSTATIC MASTER

[75] Inventors: Michael J. Whalen-Shaw, Paw Paw; Robert J. Thiessen, Richland, both of Mich.

[73] Assignee: Allied Paper Incorporated, Kalamazoo, Mich.

[ * ] Notice: The portion of the term of this patent subsequent to Oct. 6, 1998, has been disclaimed.

[21] Appl. No.: 315,287

[22] Filed: Oct. 27, 1981

Related U.S. Application Data

[63] Continuation-in-part of Ser. No. 53,168, Jun. 29, 1979, Pat. No. 4,340,659, which is a continuation-in-part of Ser. No. 827,127, Aug. 24, 1977, abandoned.

[51] Int. Cl.[3] ..... G03C 5/00

[52] U.S. Cl. ..... 430/64; 101/463.1; 101/466; 427/58; 427/121; 427/336; 430/65

[58] Field of Search ..... 427/391, 411, 58, 121, 427/336; 430/64, 65; 101/463.1, 466

[56] References Cited

U.S. PATENT DOCUMENTS

| | | | |
|---|---|---|---|
| 3,239,371 | 3/1966 | Whitney et al. | 117/155 |
| 3,541,033 | 11/1970 | Buttrick et al. | 260/8 |
| 3,674,896 | 7/1972 | Purcell et al. | 260/897 B |
| 3,707,393 | 12/1972 | McDonald | 427/411 X |
| 3,741,925 | 6/1973 | McDonald | 260/28.5 R |
| 3,872,039 | 3/1975 | Vaughn et al. | 260/17.4 ST |
| 3,899,389 | 8/1975 | Vaughn et al. | 162/168 |
| 4,042,398 | 8/1977 | Holm et al. | 427/411 X |

*Primary Examiner*—Michael R. Lusignan
*Assistant Examiner*—Thurman K. Page
*Attorney, Agent, or Firm*—Richard H. Thomas

[57] ABSTRACT

A method for the preparation of electrostatic masters, and product prepared thereby, said masters having improved water and pick resistance for lithographic printing. The method comprises applying a barrier coat formulation to a substrate wherein the formulation contains an aqueous dispersion of a copolymer of at least about 60% ethylenically unsaturated polymerizable monomer having non-polar functionality and about 3 to about 40% of a polymerizable olefinically unsaturated monomer having polar functionality.

14 Claims, No Drawings

BARRIER COAT FOR ELECTROSTATIC MASTER

This application is a continuation-in-part of prior copending application Ser. No. 053,168, filed June 29, 1979, and now U.S. Pat. No. 4,340,659, and assigned to assignees of the present application. Application Ser. No. 053,168, now U.S. Pat. No. 4,340,659 was in turn a continuation-in-part of application Ser. No. 827,127, filed Aug. 24, 1977 and now abandoned, and also assigned to assignees of the present application.

The present invention relates to electrostatic masters for lithographic printing, and particularly to improved barrier coatings for such masters. Specifically, the present inventions concerns such barrier coatings wherein the coating formulation comprises an aqueous dispersion of a copolymer of an ethylenically unsaturated polymerizable monomer having non-polar functionality and a polymerizable olefinically unsaturated monomer having polar functionality. An example of such copolymer is ethylene acrylic acid.

BACKGROUND OF THE PRESENT INVENTION

Paper electrostatic masters for lithographic printing, and the methods for making the same, are well known. Lithography depends upon the immiscibility of a greasy lithographic printing ink and an aqueous etch or lithographic solution. In use, a paper lithographic master is first imaged in a known manner and the imaged plate is then placed on a plate cylinder of an offset duplicating press. The overall surface of the plate is treated with an aqueous wet-out or fountain solution which wets all portions of the plate except those areas which have been imaged and are water repellant. The press inking rolls then pass over the surface of the plate and deposit a film of ink only upon the ink-receptive imaged areas. In the printing operation the ink from the imaged areas is transferred in reverse to a rubber offset blanket which in turn prints directly onto a paper sheet so as to form a copy.

Although imaging of the master can be obtained in a number of ways, the present invention is concerned with the preparation of masters suitable for imaging by photoelectrostatic reproduction. This type of reproduction depends upon the presence of a light sensitive photoconductive pigment dispersed in an insulating matrix of a resinous, film-forming material. An electrostatic charge is applied to the surface of the photoelectrostatic coating in the absence of light, and on exposure of the charged surface to an optical image, the charge is dispersed except in those areas which are imaged. Toning of the surface then converts the electrostatic image to a permanent visible image which is ink receptive.

During the printing step, in the offset duplicating press, the fountain solution is compressed or squeezed by the press rolls against the surface of the lithographic plates. This is a more severe exposure to water than most applications for paper and the water is readily worked into the body of the paper. If this occurs, the surface of the plate may become less completely wetted-out by water because water has been withdrawn from the surface into the plate. Therefore, the surface may not repel the printing ink, and areas of the surface which should be perfectly blank will darken or "tone". In addition, absorption of water into the base paper is likely to cause picking of the coats of the electrostatic master, resulting in loss of image in areas where the picking has occurred.

These and other difficulties are particularly great when the plates are used for long runs and are therefore subjected to repeated wettings and inkings. Attempts have been made to overcome the difficulties by employing water resistant barrier coatings beneath the photoconductive layer. For instance, it is known to employ a styrene-butadiene latex, in the amount of about 15% of the barrier coat formulation, with about 5% casein or protein and about 80% filler, primarily coating clay. Other coating materials which have been employed are acrylates, polyvinyl acetates, polyvinylidene chloride, and ethylene vinyl chloride. All of these materials have a common characteristic in that they are all manufactured using surfactants in the polymerization process to form the latices. Surfactants, because of their ionic or hydrophilic nature, tend to reduce water resistance in the polymer film, providing a less than satisfactory water barrier.

For purposes of the present invention, water resistance is defined in terms of the amount of liquid water passing into the sheet in a given time. The test commonly employed to measure water resistance is referred to as the Cobb test, and the amount of water absorbed is measured in terms of grams per square meter of substrate. The period of exposure may be 2½ minutes or 10 minutes.

It is known to apply formulations to a paper base, which formulations contain ethylene acrylic acid. This is, for instance, disclosed in U.S. Pat. No. 3,541,033 to Buttrick et al, patented Nov. 17, 1970, wherein the ethylene acrylic acid coating is said to provide improved wet rub characteristics in printing paper. The ethylene acrylic acid is applied from a latex formulation containing a surfactant in combination with a large percentage of clay and the resulting coating would provide a less than satisfactory water barrier for electrostatic masters.

It is also known to use ethylene acrylic acid, in either latex form or colloidal solution form, as sizing agents for paper. This is disclosed in U.S. Pat. Nos. 3,239,371 to Whitney et al., (Mar. 8, 1966); 3,899,389, issued Aug. 12, 1975 to Vaughn et al; 3,872,039, issued Mar. 18, 1975, to Vaughn et al; and 3,674,896, issued July 4, 1972 to Purcell et al. These patents teach the use of ethylene acrylic acid both in latex form and colloidal solution form as sizing agents for paper. Either retention aids, waxes, cross-linking polymers, or other polymer additives are required. Sizing refers to the treatment of fibers to provide water repellancy, and is carried out at either the wet end of the paper machine or at a size press of the machine. It is not generally considered a coating procedure in the sense that continuous films are formed on a paper substrate. By way of example, paper sized with ethylene acrylic acid in accordance with the procedure of U.S. Pat. No. 3,674,896 will allow a water absorption, as determined by the Cobb test, of about 62 grams per square meter. By contrast, the water absorption of a paper product, prepared in accordance with the concepts of the present invention, blade coated with ethylene acrylic acid, will have a water absorption on the order of about 15 grams per square meter.

U.S. Pat. No. 3,741,925 teaches the use of ethylene acrylic acid in conjunction with a wax, as a textile size. As with the above patents directed to the preparation of paper products sized with ethylene acrylic acid, this patent is not an anticipation of the present invention, for the same reasons.

BRIEF DESCRIPTION OF THE PRESENT INVENTION

In accordance with the concepts of the present invention, there is provided a method for the preparation of lithographic masters, having improved water resistance and conductivity at low coat weights, comprising applying to a base having a need for water resistance, at least one coat in the form of a barrier coat consisting essentially of a film forming polymer, with or without filler, said polymer being an aqueous dispersion of a copolymer of at least 60% ethylenically un-saturated polymerizable monomer having non-polar functionality and about 3% to about 40% of a polymerizable olefinically unsaturated monomer having polar functionality; drying the formed barrier coat; and applying to said barrier coat a photoconductive coating comprising a photoconductive material and binder. The amount of film forming polymer applied is a film forming amount, defined as a sufficient amount to form a continuous or substantially continuous polymeric film.

In a preferred embodiment of the present invention, said copolymer comprises ethylene polymerized with acrylic, methacrylic or crotonic acid.

Also, in accordance with a preferred embodiment of the present invention, the barrier coat contains ammonium zirconyl carbonate cross-linked with said copolymer, as taught in copending application Ser. No. 053,168, filed June 29, 1979, and assigned to assignees of the present application.

Preferably, the base is a paper base having paper making proportions of paper making ingredients.

For purposes of the present application, the term "paper base" shall mean a paper sheet having a precoat, as well as one having no precoat. The barrier coats may be applied by any of the usual methods, for instance on a size press, by blade, roll or rod coating using known technology and apparatus, or by an air knife coater. Preferably, the barrier coat of the present invention is applied only on the functional side where water resistance is required (that side to which the photoconductive layer is applied). However, it may be desirable to also apply it to the back side, for example, to avoid curl, particularly if solvent resistance is also desired. In general, thickness of the barrier coat will depend upon the amount of water or solvent resistance desired, the thicker the coat, the more the water and solvent resistance.

By the use of the copolymer of the present invention, unexpectedly improved water resistance at very low levels of coat weight are achieved.

The conductivity of the barrier coat, in the preparation of electrostatic masters, is very important to obtain good imaging characteristics. The conductivity should be sufficient to achieve a resistivity of less than about $10^{11}$ OHMS per square for the barrier coat and substrate. It is a feature of the present invention that the copolymers hereof provide sufficiently improved water resistance at low coat weights that, even without a conductive agent, the resistivity is less than the above limit.

The film forming polymers for use in forming the aqueous dispersions of the present invention preferably are random, organic, addition copolymers or multipolymers of a non-acidic, ethylenically unsaturated polymerizable monomer and an ethylenically unsaturated aliphatic carboxylic acid. The most satisfactory resinous materials for use herein are addition polymers which are normally solid at room temperature, e.g. 25° C., thermoplastic, normally insoluble in water and contain a plurality of functional groups, e.g. carboxylic acid groups. The film forming polymers are applied as a colloidal dispersion in an ammonia or alkali solution. Particularly suitable copolymers include multipolymers of ethylene and from about 10% to about 30% by weight of one or more ethylenically unsaturated acids such as acrylic, methacrylic acid, etc., as above stated.

A particularly preferred such copolymer is an ethylene/acrylic acid copolymer marketed under the trademark XD 30508 by Dow Chemical Co., containing about 80% ethylene and about 20% acrylic acid. Such copolymers are disclosed in U.S. Pat. Nos. 3,520,861 and 3,799,901, incorporated by reference herein.

The continuity of the polymeric films of the present invention is ascertainable visually by conventional magnification, for instance using a power of 10,000. The continuity is also ascertainable by measuring water resistance. It has been determined that the water absorption, as measured by a 2½ minute Cobb test, should be less than about 10 grams per square meter, preferably less than about 4 grams per square meter. Depending upon such parameters as method of application, particular polymer employed and amount, use of composition and weight of the precoat, effective results are obtained at coat weights in the range of about 0.2 to 20 lbs/side/3300 square feet. A preferred coat weight is about 0.4–1, more preferably about 0.5 lbs. per 3300 square feet. All weights are on a dry basis.

Although it is contemplated that the film former of the present invention preferably will contain no filler or other materials, it is possible and within the broad scope of the present invention to add filler materials such as clay, silica, calcium carbonate and alumina, to provide properties such as smoothness to the film or coat. One suitable type of filler material comprises plastic particles such as disclosed in application Ser. No. 053,168, of which the present application is a continuation-in-part. The amount of plastic particles preferably will be between about 5% and 100%, based on the amount of film forming polymer employed, and will comprise from 10% to 100% of the amount of filler employed. Preferably, the plastic particle content, if used, is from about 20% to about 40%, based on the total coat weight, for both improved pick and water resistance.

The type of plastic particle is not critical, so long as it is impervious to water and/or solvents. Preferably, the plastic particles, if employed, are sensitive to the solvent system employed in application of the photoconductive layer. For instance, in the case of electrostatic paper masters bearing zinc oxide-containing coatings, the zinc oxide is normally applied from about a 50% dispersion in a solvent such as toluene. The plastic particles thus should be sensitive to the toluene or solvent used, such that on application of the zinc oxide coating the plastic particles become solubilized and, on evaporation of the toluene, form a continuous plastic film (in addition to, or in combination with the ethylene acrylic acid film). Other solvents which may be employed are aromatic compounds such as benzene, zylene, chlorinated aliphatic compounds such as methylene chloride, and ketones such as acetone and methyethyl ketone, and others known in the art.

A large number of prior patents have been granted on plastic particles useful in paper coating formulations. Representative of such U.S. Pat. Nos. are 3,968,319; 3,949,138; 3,779,800; 3,996,056; 3,281,267; the disclosures of which are incorporated by reference herein. Examples of suitable materials which may be employed in the preparation of plastic particles, sensitive to solvents, to effect solvent or water resistance, include polystyrene, polyvinyl acetate and copolymers thereof, polyvinyl butyral and copolymers thereof, polyacrylates and copolymers thereof, and mixtures of any of the above. Not included are plastic materials which are inherently water attractive or water sensitive under conditions where a lithographic master is normally used.

A preferred range for average size of the plastic particles is about 0.01 to about 20 microns.

Fillers and other materials added to the formulations of the present invention should be selected to avoid having an adverse effect on water resistance.

Preferably, the paper lithographic master of the present invention is provided with a precoat which underlies the barrier coat. The function of the precoat is to smooth irregularities on the surface of the base paper and also to provide a conductive path through the paper sheet to the backside of the sheet and to prevent lateral leakage in the barrier coat. Such precoats are well known and will comprise, typically, a styrene-butadiene, acrylic, or polyvinyl acetate latex or polymer formulation containing conventional barrier additives such as protein, casein, clay, pigments and, in addition, conductive agents such as a conductive polymer, humectants, conductive salts, quaternary ammonium compounds, and the like. In the precoat formulation of the present invention, the latex concentrations are relatively small, e.g., 10–20%, so that compatibility of certain additives such as most conductive agents with the latices, is less critical. Preferably, the precoat formulations of the present invention also comprise an amount of plastic particles, preferably in the range of about 10–20%, based on the total filler content.

An important feature of the present invention is having a sufficiently smooth, tight surface to which the barrier coat is applied so that the relatively thin barrier coat (at, for instance, less than 1 lb. per 3300 sq. ft.) forms a substantially continuous water-impervious film. Critical is preventing substantial absorption of the aqueous barrier coat formulation into the substrate surface. Although this preferably is accomplished with a precoat as above described, other techniques known in the art can be used; for instance, the use of super calendering of the base stock.

The electroconductive coating of the present invention may be used with any conventional inorganic photoconductive layer which provides the electronic charge generation necessary to perform the electrophotographic discharge. Photoconductive zinc oxide is preferred for efficiency and economy. Suitable photoconductive zinc oxides are commercially available under the name "Photox 80", and "Photox 801" (trademark New Jersey Zinc. Co.); PC 321, PC 331, and PC 340, (trademark St. Joseph Lead Co.) and ZZZ-66-1 (trademark American Zinc Smelting Co.). Suitable photoconductive insulating topcoatings are disclosed in U.S. Pat. Nos. 2,959,481, 3,052,539; and 3,431,106.

A distinct advantage of the present invention, using a colloidal solution or dispersion vs a latex film former, is that coalescence of the latex particles is not required to form the water resistant film. This is noteworthy since often other materials which may be added to the latex to provide secondary properties such as clay to provide smoothness, interfere with coalescence of the latex particles on drying. Wnen a colloidal polymer solution is used to provide water resistance, other materials are simply coated themselves when the coated sheet is dried.

The following example will illustrate the concepts of the present invention, and unexpected improvement in water resistance at low coat weight, compared to other water resistant film forming polymers achieved by the present invention.

EXAMPLE I

A precoated sheet of 65 lbs. per 3,300 square feet was obtained by blade coating a paper base with a precoat, at the rate of 10 lbs. per side, the precoat formulation consisting of 5 parts protein, 20 parts styrene-butadiene latex and 10 parts Dow 722 plastic pigment, based on 100 parts of No. 2 Kaolin coating clay (No. 2 HT Coating Clay, trademark Englehart Minerals and Chemicals Corp.). The Dow 722 plastic particles (trademark Dow Chemical Co.) were polystyrene and had an average particle size of about 0.50 microns. About 10% of a melamine formaldehyde cross-linking agent, based on the amount of binder, was also employed in the formulation. This precoated paper was then given one nip steel-to-steel calendering at 60 psi.

The paper was then blade coated on one side with a formulation consisting essentially of varying amounts of the film forming polymers shown in the following Table 1, at coat weights ranging from 0.2 lbs. per 3,300 square feet (dry basis) to 4 lbs. per 3,300 square feet. The paper, following drying, was tested for water resistance using the afore-mentioned Cobb test.

Samples of the same paper were coated with a zinc oxide coating following conventional techniques. Specifically, the sheets were rod coated with 20 lbs. per 3,300 square feet of zinc oxide photoconductive coat of conventional formulation in a toluene solvent. The resulting masters were then tested with a wet pick test, and also for good imaging characteristics.

The Cobb test is described in TAPPI Standards and Testing Methods, P 441 M. Essentially, it involves placing the finished paper in contact with water for 2½ minutes, discarding the water, gently blotting excess water off the paper, and then determining the weight of water absorbed. This procedure correlates well with the amount of water actually absorbed on a printing press.

The procedure for wet pick test is as follows:

| PROCEDURE FOR I.G.T. PICKS - WET AND DRY | |
|---|---|
| Materials: | |
| I.G.T. Tester | "Instituut voor Grafische Technick<br>T.N.O. Amsterdam 0.1–0.6"<br>35" 20"<br>Supplied by: Rudolph Meiher's Inc.<br>Amsterdam, Holland<br>Brouwersgracht 152/154<br>Equipped with 2 speeds (A = slow - 450 ft/min. maximum velocity and B = fast - |

-continued

| PROCEDURE FOR I.G.T. PICKS - WET AND DRY | |
|---|---|
| | 650 ft/min. maximum velocity) an adjustable pressure device and a spring drive device. |
| Inks | Inmont IPI Printing Inks - Black |
| Inking Apparatus | Timken A-2037<br>Single disk (of 9 mm width and 8" circumference) with a doctor-blade type metering device set for a 2 mil ink thickness. |
| PROCEDURE: | This procedure is a modification of TAPPI suggested method T 499 su-64.<br>Samples were conditioned for −15 hours at 50% Rh prior to testing.<br>Strips were cut 1" × 10" along the machine direction from areas free from wrinkles, creases, etc. The strips were handled only by the edges so that the surface was free of oil and fingerprints.<br>Ink was applied directly to the inking apparatus disk with a spatula and the disk was turned in a clockwise direction in order to evenly distribute the ink over the entire surface at a 2 mil thickness.<br>A #3, 5, or 8 tack ink was used for the wet picks. The strips were completely submersed in water and allowed to soak for 5 minutes. The strips were then blotted to soak for 5 minutes. The strips were then blotted to remove the excess water and tested immediately.<br>Pick results were recorded as distance in cm from the top of the inked area of the sample to the pick itself. The first sign of ink or fiber pick, no matter how small, was designated as the "1st pick". The point of total ink or fiber pick was designated as the "major pick". |

In general, it can be said that the larger the pick distance in centimeters, the better the pick test.

For imaging, the masters were, after preparation, conditioned overnight to 50% relative humidity and imaged on an A. B. Dick 675 Mastermaker. The masters were evaluated with respect to background and image mottle. The results of these tests are summarized in the following Table 1.

TABLE 1

| Code | Latex | Theoretical Coat Weight | 2½ min. Cobb test g/m² | I.G.T. Wet Pick #3 Ink | Imaging "8" Exposure |
|---|---|---|---|---|---|
| G | XD 30508 (EAA) | 0.2 | 17.94 | 185 | VG |
| | | 0.5 | 3.20 | None | VG |
| | | 1.0 | .77 | None | VG |
| | | 2.0 | .23 | None | F |
| | | 4.0 | .09 | None | VP |
| H | Saran 112 (Saran) | 0.2 | 25.5 | 210 | VG |
| | | 0.5 | 19.2 | 185 | VG |
| | | 1.0 | 12.4 | 185 | VG |
| | | 2.0 | 1.70 | 305 | VG |
| | | 4.0 | .57 | 320 | VG |
| I | R & H B-15 (Acrylic) | 0.2 | 28.88 | 230 | VG |
| | | 0.5 | 26.32 | 70 | VG |
| | | 1.0 | 25.75 | 85 | VG |
| | | 2.0 | 25.07 | 200 | — |
| | | 4.0 | 26.89 | None | — |
| J | Celanese 6107 (vinyl acetate) | 0.2 | 25.46 | 160 | VG |
| | | 0.5 | 21.58 | 250 | G |
| | | 1.0 | 20.64 | 215 | G |
| | | 2.0 | 14.57 | 230 | F |
| | | 4.0 | 9.99 | 190 | P |
| K | DL 620 (SBR) Dow | 0.2 | 30.69 | 185 | VG |
| | | 0.5 | 33.38 | None | F |
| | | 1.0 | 34.78 | 225 | F-G |
| | | 2.0 | 36.68 | None | F-G |
| | | 4.0 | 29.07 | None | F |

In Table 1, the ethylene acrylic acid was applied from a colloidal dispersion having about 10% solids, and no filler.

The Saran 112 was polyvinylidene chloride latex marketed by Dow Chemical at 50% solids. For use in this Example, the latex was diluted with distilled water to about 25% solids. The B-15 acrylic was polyacrylate latex marketed by Rohm & Haas. DL 620 is styrene-butadiene latex marketed by Dow Chemical Co. Celanese 6107 is vinyl acetate marketed by Celanese Corporation. The above designations are all trademarks.

The above table shows that optimum results were obtained with the ethylene acrylic acid at coat weights of about 0.5–1 lb./3300 square feet. The amount of water absorbed in the 2½ minute Cobb test was about 3.20 and 0.77 grams per square meter, respectively. As the coat weight was increased to about 2–4 lbs., the Cobb tests results were better (0.23 and 0.09, respectively), but the films became too dielectric for good imaging, and the resulting imaging was only fair or very poor. In all of the tests, no wet pick was noticed.

Similar 2½ minute Cobb test data is given for the several latices, showing about a five-fold improvement in water resistance employing ethylene acrylic acid. For instance, at about 0.5 lbs. coat weight, Saran gave a water absorption of about 19.2 grams per meter square vs 3.2 grams for ethylene acrylic acid. At about 1 lb. coat weight, the comparative data was 12.4 grams vs 0.77. Even worse results were experienced with the other latices. At heavier coat weights of about 2 and 4 lbs, the Cobb test data for Saran was acceptable, but at these coat weights the Pick Test data was unacceptable.

In summary, the data of Table 1 shows that for electrostatic masters an ethylene acrylic acid barrier coat is capable of giving a combination of properties, including remarkably improved water resistance unattainable with conventional laticies used for this purpose.

What is claimed is:

1. A method for the preparation of electrostatic masters having improved water and pick resistance for lithographic printing comprising the steps of (a) applying to a base a barrier coat formulation which comprises an aqueous dispersion of a copolymer of at least about 60% ethylenically unsaturated polymerizable monomer having non-polar functionality and about 3% to about 40% of a polymerizable olefinically unsaturated monomer having polar functionality;

(b) drying the formed barrier coat; and (c) applying to said barrier coat a photoconductive coating comprising a photoconductive material and binder.

2. The method of claim 1 wherein said copolymer comprises ethylene polymerized with acrylic, methacrylic or crotonic acid.

3. The method of claim 1 employing a paper base.

4. The method of claim 1 wherein said barrier coat formulation is applied in a film forming amount, the base surface being substantially impervious to penetration of the barrier coat formulation during application of such formulation.

5. The method of claim 4 wherein said barrier coat formulation is applied at a coat weight such as to obtain a resistivity less than about $10^{11}$ OHMS per square for the barrier coat and base.

6. The method of claim 1 wherein the barrier coat weight, dry basis, is about 0.4–1 lb. per 3300 square feet.

7. The method of claim 4 wherein said base has applied to it a calendered precoat beneath said barrier coat, said precoat comprising a binding amount of a synthetic resin binder and a filler, at least 10% of said filler being plastic particles.

8. An electrostatic master prepared by any of the methods of claims 1–7.

9. A method for the preparation of base paper suitable for electrostatic masters having improved water and pick resistance for lithographic printing comprising the steps of (a) applying to a paper substrate a barrier coat formulation which comprises an aqueous dispersion of a copolymer of at least about 60% ethylenically unsaturated polymerizable monomer having non-polar functionality and about 3% to about 40% of a polymerizable olefinically unsaturated monomer having polar functionality;

(b) drying the formed barrier coat, the conditions of application and drying providing a thin water impervious film;

(c) said barrier coat formulation being applied at a coat weight such as to obtain a resistivity less than about $10^{11}$ OHMS per square for the barrier coat and base.

10. The method of claim 9 wherein said barrier coat weight, dry basis, is about 0.4–1 lb. per 3300 square feet, the continuity of said coat being sufficient to limit the water absorption, as measured by a 2½ minute Cobb test to less than about 10 grams per square meter, the substrate during application of the barrier coat being substantially impervious to penetration of the barrier coat formulation during application of such formulation.

11. The method of claim 10 wherein the said water absorption is less than about 4 grams per square meter.

12. The method of claim 10 wherein said base has applied to it a precoat beneath said barrier coat, said precoat comprising a binding amount of a synthetic resin binder and a filler, at least 10% of said filler being plastic particles.

13. The method of claim 9 wherein said barrier coat formulation contains plastic particles filler, the plastic particles being non film-forming under conditions of application and drying of the barrier coat.

14. An electrostatic master base paper prepared by any of the methods of claims 9–13.

* * * * *